United States Patent [19]

Knaak

[11] Patent Number: 4,574,574

[45] Date of Patent: Mar. 11, 1986

[54] TENSION REGULATOR FOR A STRANDING MACHINE

[75] Inventor: Hans Knaak, Aachen, Fed. Rep. of Germany

[73] Assignee: Stolberger Maschinenfabrik GmbH & Co. KG, Stolberg, Fed. Rep. of Germany

[21] Appl. No.: 678,214

[22] Filed: Dec. 4, 1984

[30] Foreign Application Priority Data

Dec. 10, 1983 [DE] Fed. Rep. of Germany ..... 3344731

[51] Int. Cl.[4] ..... D07B 3/06; H01B 13/02

[52] U.S. Cl. ..... 57/59; 57/3; 57/19; 57/58.54; 57/264; 57/314; 242/45

[58] Field of Search ..... 57/59, 264, 18, 314, 57/19, 3, 60, 58.52, 58.57; 242/128, 45

[56] References Cited

U.S. PATENT DOCUMENTS

| | | | |
|---|---|---|---|
| 3,543,501 | 12/1970 | Schillebeeckx | 57/59 |
| 3,590,567 | 7/1971 | Bonikowski et al. | 57/3 |
| 4,073,127 | 2/1978 | Orlandi et al. | 57/59 X |
| 4,102,117 | 7/1978 | Doknberger | 57/59 X |
| 4,317,328 | 3/1982 | Allard | 57/59 |
| 4,398,677 | 8/1983 | Henrich | 242/45 X |

FOREIGN PATENT DOCUMENTS 201478 1/1959 Austria .

2540728 3/1977 Fed. Rep. of Germany .

*Primary Examiner*—John Petrakes

*Attorney, Agent, or Firm*—Spencer & Frank

[57] ABSTRACT

A stranding machine including a plurality of reels on which filament to be stranded is wound; a separate, rpm-controllable motor connected with each reel; rpm control devices connected to each reel motor for controlling the reel rpm with respect to the stranding speed to determine the tension of the filament running from the reel; a separate compensating roller associated with each reel; and a separate support component carrying a respective compensating roller and being displaceable in opposite first and second directions. Each support component is coupled to the respective rpm control means for controlling the rpm of the respective reel drive motor as a function of displacement of the support component. The filament, as it runs about the compensating roller, exerts a force on the support component in the first direction. A force exerting assembly is connected with each support component for exerting a force on the support component in the second direction. The force exerting assembly has an electromagnetic slip clutch whose rotor is connected with a drive motor and whose armature is connected with the compensating arm and further, a device is provided to control the current supply to the stator of the slip clutch.

10 Claims, 2 Drawing Figures

TENSION REGULATOR FOR A STRANDING MACHINE

BACKGROUND OF THE INVENTION

The invention relates to a cable stranding machine having a plurality of reels supporting the individual filaments to be stranded. Each reel is coupled with an rpm-variable motor for adapting the reel rpm to the stranding speed to determine the tension in the filament as it runs from the reel to the location of stranding. With each reel there is associated a deflecting roller and a compensating roller (filament tension responsive roller) for guiding the filament to be stranded. The compensating roller is carried at the end of a movable support component, such as a compensating arm and with each compensating arm there is connected an arrangement for generating a force (torque) applied to the compensating arm and an arrangement for controlling the rpm of the reel motor.

In cable making, the individual filaments run from respective supply reels, and are directed by guiding elements to the location of stranding where the actual cable forming (stranding) proper takes place. In order to achieve a stranding which yields a high-quality cable, a constant tension must be set and maintained for the individual filaments. In case the filaments to be stranded are not sensitive to tension forces, it is sufficient to appropriately brake the reels of the individual filaments to thus obtain the desired tensioning force.

In case of highly sensitive materials, however, such as glass fiber filaments to be used as optical fibers or copper filaments to be used for making miniature cables, the setting of the tensioning force in the individual filaments by means of a simple braking of the wheel is, for all practical purposes, not possible because the bearing friction in the reel alone generates a tensioning force on the individual filament which is higher than permissible to avoid filament damage. To counteract this effect, the individual reels have to be expediently provided with a four-quadrant electric drive. For controlling the rpm of the reel drive to thus regulate the tensioning force, it is known to have a torque act on the compensating arm by means of a spring. The torque opposes that of the compensating arm, applied thereto by the filament. Further, the compensating arm is coupled with a potentiometer which affects the control of the reel drive motor so that a change in the position of the compensating arm directly varies the rpm of the reel drive motor. By appropriate pre-setting of the spring tension the desired tensioning force may be predetermined in the filament so that the setting torque applied by the spring and the counter torque applied by the tensioning force of the filament are maintained in equilibrium. An excessively high or an excessively low rpm of the reel causes a pivotal motion of the compensating arm and thus changes the setting of the potentiometer. This results in a corresponding change of the rpm of the reel drive motor so that the compensating arm, by means of a torque equilibrium, may assume once again its predetermined initial (basic) position.

It is a particular disadvantage of the above-outlined known apparatus that during a setting motion against the spring force there occurs an increase of the tension force in the filament. Such an increase may lead to damages by stretching the filament should the latter be of a highly sensitive type which allows an exposure to a tensioning force of, for example, not more than 0.5

Newton. The use of springs has a further disadvantage that the change in the tensioning force must also be effected with mechanical means by changing the spring bias. Such a setting, in case of small tolerances, can be effected with the desired accuracy and reproduceability under the given narrow tolerances only with great difficulty, if at all.

SUMMARY OF THE INYENTION

It is an object of the invention to provide, for a stranding machine, an improved tensioning force regulation which has a significantly increased sensitivity as compared to prior art tensioning arrangements.

This object and others to become apparent as the specification progresses, are accomplished by the invention, according to which, briefly stated, the means which generate a torque applied to the compensating arm include an electromagnetic slip clutch whose rotor is connected with a drive motor and whose armature is connected with the compensating arm and further, means are provided to control the current supply to the stator of the slip clutch.

The above-outlined arrangement according to the invention has the advantage that the setting torque applied to the compensating arm is constant, independently from the position of the compensating arm. Further, disturbance effects are reduced, since an electromagnetic slip clutch operates in a contactless manner, that is, the armature coupled with the compensating arm is connected with the rotor of the slip clutch solely by means of a magnetic field. In this manner, interfering forces are limited to the friction forces generated in the bearing of the compensating arm. A further reduction of mechanical interfering forces may be effected by providing that the means for controlling the rpm of the reel drive motor comprises a low-friction potentiometer. The changing of the setting torque applied to the compensating arm is effected by changing the exciting current in the stator winding of the slip clutch. The torque is steplessly settable so that the torque to be applied by the electromagnetic slip clutch may be set to any desired magnitude between zero and a predetermined maximum value.

According to a further feature of the invention, the slip clutch is, together with its drive motor and the associated deflecting roller and the compensating arm, supported on the reel carrier. Such an arrangement has the advantage that the filament to be stranded may be guided over the deflecting roller and the compensating roller in a twist-free manner. According to another feature of the invention, the compensating arm is provided with two counter weights functioning as a centrifugal force equalizer for the compensating roller. It is a further feature of the invention to make the compensating device essentially of synthetic material, preferably of a fiber-reinforced plastic. Such a material has the advantage that the mass moment of inertia of the compensating device is significantly reduced and thus responds to a change in the reel rpm more rapidly and consequently, the sensitivity of the regulating system according to the invention is further increased.

DESCRIPTION OF THE PREFERRED EMBODIMENT

Figure 1:
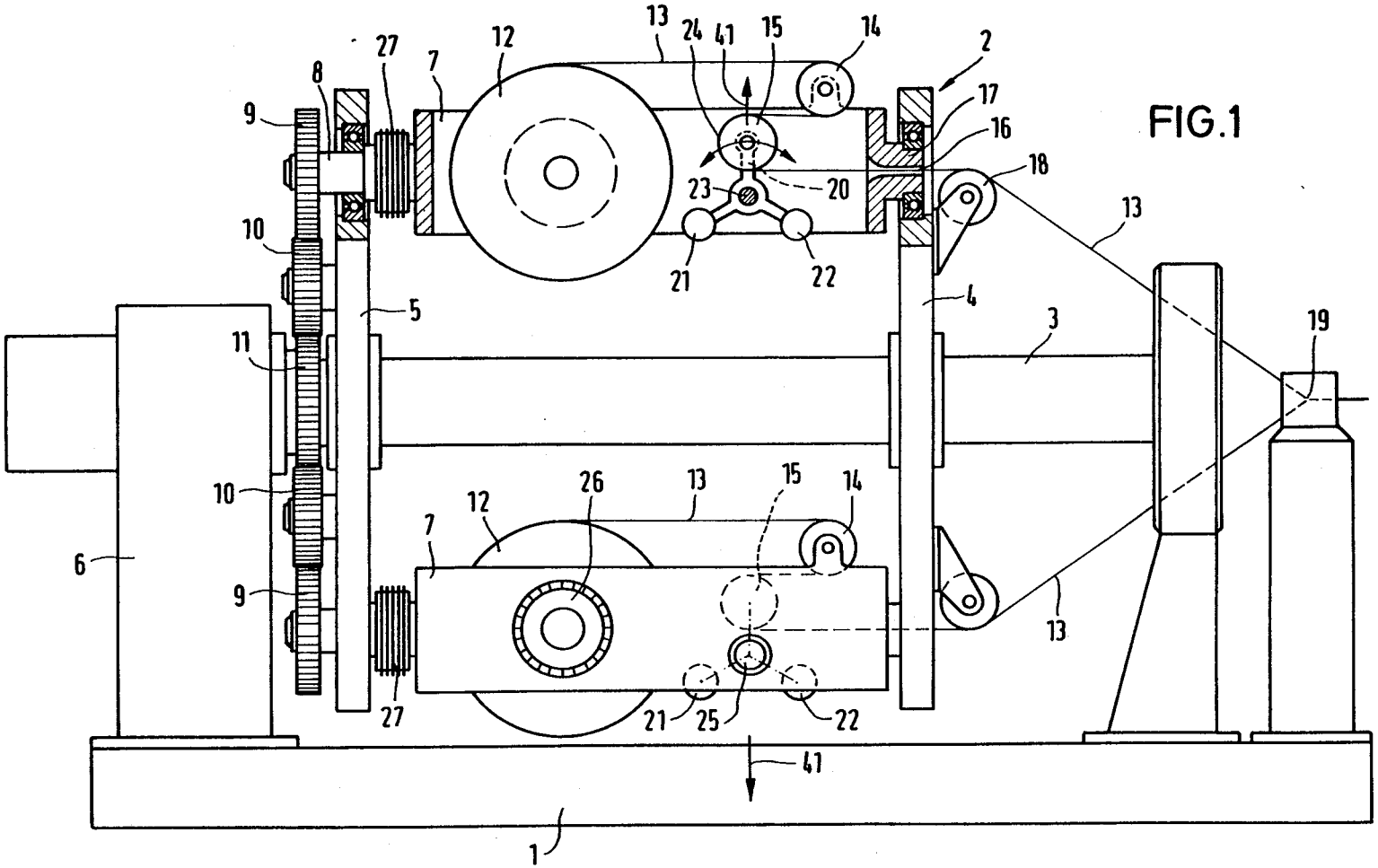
FIG. 1 is a schematic side elevational view, partially in section, of a preferred embodiment of the invention.

Turning now to FIG. 1, the illustrated stranding machine has a base frame 1 supporting a rotor 2 which comprises a main shaft 3 and yoke discs 4 and 5 affixed to the shaft 3 in an axially spaced relationship. The main shaft 3 is supported in a drive housing 6 where it is operatively coupled with a drive motor in a conventional manner, not shown. The yoke discs 4 and 5 rotatably support a plurality of frame-like reel carriers 7 arranged in a circular array about the main shaft 3. In the zone of the yoke disc 5 the shaft 8 of each respective reel carrier 7 extends through the yoke disc 5 and is provided at its end with a gear 9. Each gear 9 meshes with a separate intermediate gear 10 also rotatably supported by the yoke disc 5. The intermediate gears 10, in turn, mesh with a sun gear 11 which is rigidly affixed to the drive housing 6 coaxially with the shaft 3, so that during rotation of the rotor 2 the reel carriers 7, together with the reels 12 carried thereby, remain oriented in the vertical direction, provided that the gears 9 and the sun gear 11 have the same diameter.

On each reel 12 supported by the respective reel carrier 7, there is wound the filament 13 to be stranded, for example, a glass filament for making an optical cable. The filament 13, as it runs off from its reel 12, is trained about a deflecting roller 14 supported on the reel carrier 7 and a compensating roller 15, also supported on the reel carrier 7 and then passes through a bore 16 provided in the shaft 17 of the reel carrier 7. On the outside of the yoke disc 4, with each reel carrier 7 there is associated a guide roller 18 which orients the filament 13 towards the stranding location 19.

Each compensating roller 15 is supported on a pivotal compensating arm 20 which, in the described embodiment, is provided with two counter weights 21 and 22 at its side oriented away from the compensating roller 15. The weight and distance of the counter weights 21, 22 from the axis of the compensating shaft 23 of the compensating arm 20 are so dimensioned that the entire arrangement is in equilibrium with respect to the mass forces generated by centrifugal accelerations. The compensating arm 20, together with the compensating roller 15 is supported in the reel carrier 7 for an oscillating motion about the shaft 23 in the direction of the arrow 24. One end of the compensating shaft 23 is connected with a potentiometer 25 while the other end of the compensating shaft 23 is connected with an electromagnetic slip clutch 29 for generating a torque applied to the compensating shaft 23 and thus affecting the compensating arm 20. The structure and operation of this arrangement will be described in greater detail later with reference to FIG. 2.

Each reel 12 is connected with its own rpm-controllable reel drive motor 26. The reel drive motors 26 as well as the electromagnetic slip clutches 29 are supplied with electric current by means of commutator ring assemblies 27 which, in a manner not described in greater detail, cooperate with respective brushes supported on the yoke disc 5. The brushes, in turn, are coupled with a main slide ring member (not shown) which is mounted on the main shaft 3 adjacent the drive housing 6.

Figure 2:
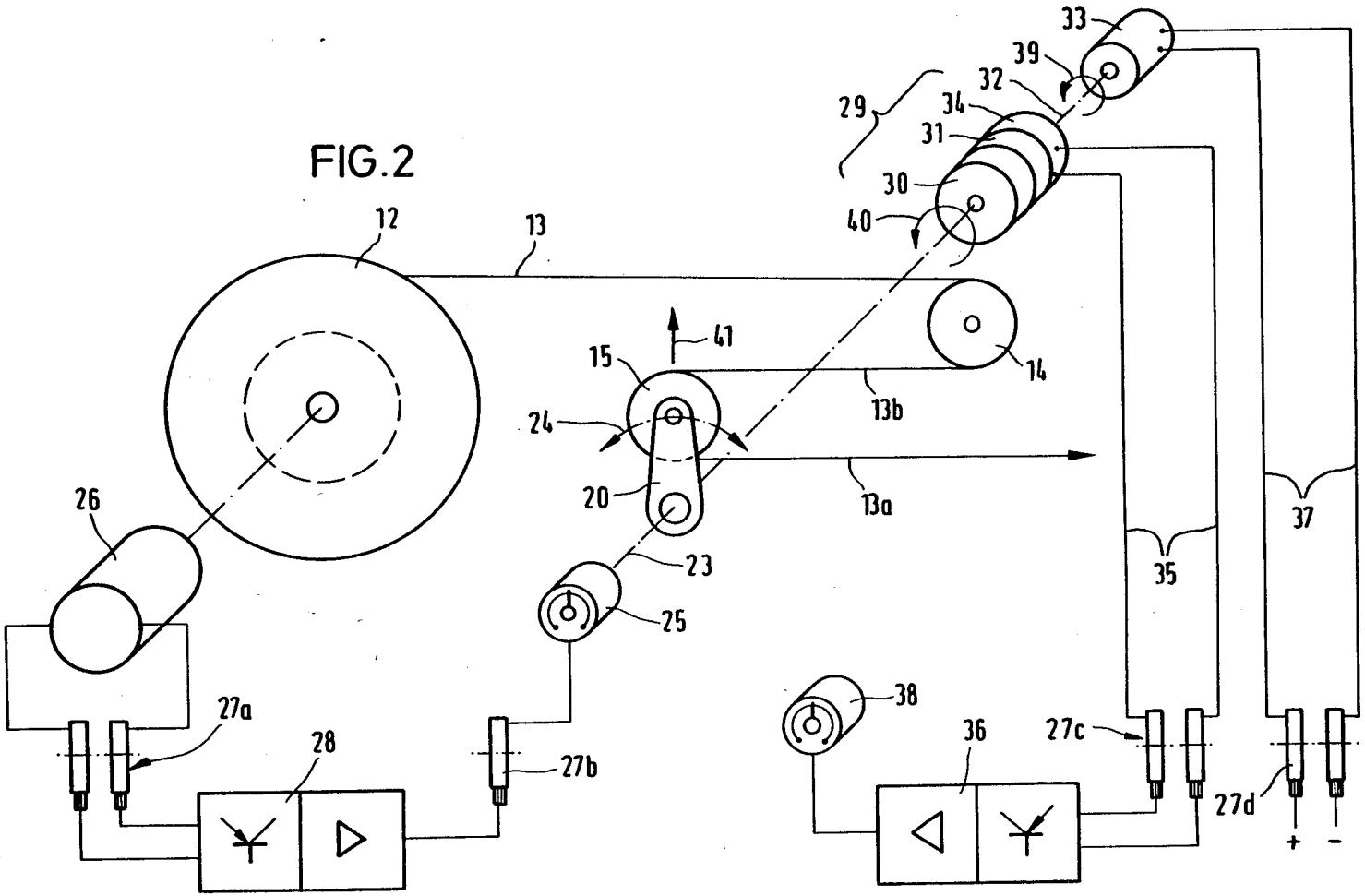
FIG. 2 is a schematic perspective view, including a block diagram, of a regulating device according to the invention and incorporated in the structure illustrated in FIG. 1.

FIG. 2 illustrates a regulator system for the tension control of one filament 13. The reel 12 from which the filament 13 is taken is driven by a d.c. motor 26 having a four-quadrant control. Current is supplied to the drive motor 26 by means of a commutator ring 27*a* of the commutator ring assembly 27 from an electronic control circuit 28 of conventional construction for varying the rpm of the drive motor 26. The setting signal for the electronic control circuit 28 is generated by the potentiometer 25 connected with the compensating shaft 23. The setting signal is transmitted by means of a commutator ring 27*b* of the commutator ring assembly 27 to the control circuit 28. A pivotal motion of the compensating arm 20 in the direction of the reel 12 leads to a reduction, while a pivotal motion of the compensating arm 20 in the opposite direction leads to an increase of the rpm of the drive motor 26, thus resulting in a reduction and, respectively, an increase of the runout speed of the individual filament 13 guided over the compensating roller 15.

For setting the tensioning force, the compensating shaft 23 is, with its other end, connected with the slip clutch 29 which is of the electromagnetic hysteresis type. The armature 30 of the slip clutch 29 is fixedly connected with the compensating shaft 23, while the rotor 31 of the slip clutch 29 is connected with a small electromotor 33 by means of a shaft 32. The armature 30 has on its side oriented towards the rotor 31 a collar-like projection which extends in a circumferential groove of the rotor 31 whereby the armature 30 and the rotor 31 may rotate independently from one another.

With the rotor 31 there is associated a stator 34 carrying a winding which is connected by means of conductors 35 with a current supply and regulating device 36. The device 36 is arranged in a control panel box, and current supply for the stator winding 34 is effected by means of corresponding commutator rings 27*c* forming part of the commutator ring assembly 27. The motor 33 is, by means of a cable 37 and commutator rings 27*d* connected to a current supply and has the sole function of driving the rotor 31 of the clutch 29. For this purpose, the motor 33 is expediently a permanently energized d.c. drive motor which is driven, for example with an rpm of $n=100/\text{min}$.

With the current supply and regulating device 36 there is associated a potentiometer 38 which serves as a desired value setter for the energization of the stator winding 34 of the clutch 29. As long as the stator coil 34 is in a de-energized state, no magnetic field appears in the rotor 31 so that the rotation of the rotor 31 is without effect on the armature 30. As soon as the stator winding 34 is energized, a magnetic field builds up dependent upon the intensity of the current and, as a result, the rotor 31, by means of the magnetic field force, seeks to entrain the armature 30 in the same direction of rotation by means of the collar of the armature 30 extending into the annular groove of the rotor 31. Thus, in case of a direction of rotation of the motor 33 as indicated by the arrow 39, the armature 30 turns in the direction of the arrow 40, whereby the compensating arm 20 is pivoted towards the reel 12 (leftward, as viewed in FIG. 2). The compensating arm 20, however, is, by means of the running filament 13, held against rotation in the rotary direction 40 of the armature 30, so that the magnetic field that has built up in the rotor 31 maintains a constant torque whose magnitude is also a function of the predetermined length of the compensating arm 20 and which has to be taken up by the filament length 13*a* running from the compensating roller 15 to the location of stranding 19 and by the filament length 13*b* running from the deflecting roller 14 to the compensating roller 15. The torque transmitted by the rotor 31 to the armature 30 is proportionate to the presettable current consumption of the stator winding 34 and may be varied by means of the potentiometer 38 functioning as a desired value setter. By presetting a torque by means of the current flow through the stator winding 34 it is thus feasible to predetermine a defined tensioning force for the individual filaments 13 to be stranded.

The torque applied by the clutch 29 to the compensating arm 20 is constant in case of a constant current supply to the stator winding 34 and is independent from the excursions of the compensating arm 20. If the potentiometer 25 associated with the compensating arm 20 is brought into the illustrated mid position and for the drive motor 26 there is preset a basic rpm and further, by means of the potentiometer 38 there is preset a desired torque which is proportional to the required tensioning force in the filament 13 and is predetermined by the properties of the filaments to be stranded, an excessively low reel rpm leads to a turning motion of the compensating arm 20 against that indicated by the arrow 40 and thus a corresponding displacement of the potentiometer 25 results. Consequently, by means of the potentiometer 25 and the associated regulating device 28 the rpm of the drive motor 26 is increased as long as the compensating arm 20 has not reassumed its predetermined mid position. If, on the other hand, the reel rpm is excessively high, the clutch 29 seeks to entrain the compensating arm 20 so that the potentiometer is displaced in the opposite direction and the rpm of the drive motor 26 is decreased as long as the compensating arm 20 has not reassumed its original position. It is a decisive factor in this arrangement that the regulating motion of the compensating arm 20 does not effect any deviation from the desired tensioning force since the torque applied by the clutch 29 to the compensating arm 20 is dependent exclusively from the current steplessly settable by the potentiometer 38.

In order to maintain the tensioning force particularly accurately constant in case of delicate filaments, care has to be taken that the current flowing through the stator winding 34 is maintained at a constant value and thus any resistance fluctuations in the circuit, for example, transitional resistances in the commutator ring 27*c* are automatically compensated for. Such a compensation may be effected by a conventional arrangement well known in electronic circuits; such an arrangement is therefore not described in greater detail.

Since each of the reel carriers 7 is equipped with a separate system described above, on the control panel a plurality of desired value setter potentiometers 38 are arranged, corresponding in number to the number of the reel carriers 7. It is, however, feasible to provide a single desired value setting potentiometer serving a plurality of reel carriers 7. Individual circuits have, however, the advantage that even during the stranding operation, for each filament 13 separate corrections may be made which are independent from the setting for all the other filaments.

Reverting to FIG. 1, the compensating arm 20 is provided with counter weights 21 and 22 which are supported on appropriately dimensioned arms to ensure that the centrifugal acceleration affecting the compensating device in the direction of the arrow 41 cannot generate mass forces which would be effective as a torque. By making the compensating device of lightweight materials, particularly fiber reinforced plastics, the mass of the compensating device may be significantly reduced. As a result, by virtue of the centrifugal acceleration only small mass forces are applied to the compensating device which leads to a further reduction of the bearing friction of the compensating shaft 23. It is a particular advantage of this arrangement that the mass moment of inertia of the compensating device is reduced with respect to its rotary axis so that as the regulating steps are performed, the mass moment of inertia to be overcome by the clutch torque or, as the case may be, by the tensioning force in the individual filament, is reduced as well. Thus, as an end result, there is achieved an increase of the "response sensitivity" of the compensating device operating on the principle of a "torque balance".

A device structured as described above is, in principle, adapted for all types of stranding machines and for all types of filaments to be stranded. The invention is, however, of particular advantage for use in stranding machines for making optical cables from glass fibers, because, with the stranding machine incorporating the invention, it is feasible to set tensioning forces between 0.5 and 5 Newton in a reliable and practically fluctuation-free manner. It is a decisive aspect of the invention that the predetermined setting in a continuous operation of, for example, 120 hours, remains very accurately constant without interruption which is a requirement, for example, in the manufacture of optical cables. By using the electronic regulating circuit 36 it is ensured that the oscillations in the current intensity which may occur because of changes in the ohmic resistance of the supply line or because of changes in the transitional resistances in the commutator rings 27*c*, may be regulated in a reliable manner, ensuring the maintenance of the required constant tensioning force. The reel drive motor 26 is, for such applications, formed as a regulating motor.

It is to be understood that, as a modification of the described embodiment, instead of a compensating arm, the compensating roller may be supported on a carriage or sled to which there is applied, in the one direction, the tensioning force of the filament and in the other direction, by means of appropriate transmission levers or the like, a counter force which corresponds to the torque of the slip clutch. In such an arrangement a higher friction force has to be taken into consideration so that this arrangement is adapted in particular for less delicate filament.

The regulating system according to the invention as described above is adapted not only for a cage-type stranding machine as described, but may find application, with appropriate adaptation, in the stranding machines of other construction.

It will be understood that the above description of the present invention is susceptible to various modifications, changes and adaptations, and the same are intended to be comprehended within the meaning and range of equivalents of the appended claims.

What is claimed is:

1. In a stranding machine including a plurality of reels on which filament to be stranded is wound; means for stranding together, with a stranding speed, the filaments taken off the reels; a separate, rpm-controllable motor operatively connected with each said reel; rpm control means operatively connected to each reel motor for controlling the reel rpm with respect to the stranding speed to determine the tension of the filament running from the reel; a separate compensating roller associated with each reel; the filament running from each reel being at least partially trained about a respective said compensating roller; a separate support component carrying a respective said compensating roller and being displaceable in opposite first and second directions; each said support component being operatively coupled to the respective said rpm control means for controlling the rpm of the respective said reel drive motor as a function of displacement of said support component; said filament, as it runs about the compensating roller, exerting a force on said support component, urging said support component in said first direction; and a force exerting assembly operatively connected with each said support component for exerting a force on said support component in said second direction; the improvement wherein said force exerting assembly comprises (a) an electromagnetic slip clutch including
  (1) a stator winding;
  (2) a rotor cooperating with said stator winding;
  (3) motor means for rotating said rotor for generating by said rotor a rotating electromagnetic field in an energized state of said stator winding;
  (4) an armature exposed to a torque derived from said rotating electromagnetic field; said armature being connected to said support component for exerting thereon said force acting in said second direction as a function of the magnitude of said torque;
(b) current supply means for applying current to said stator winding and
(c) current control means connected to said current supply means for setting the intensity of the current applied to said stator winding for determining the strength of said electromagnetic field.

2. A stranding machine as defined in claim 1, further comprising a plurality of reel carriers supporting a respective said reel; a deflecting roller supported on each reel carrier for guiding the respective filament; said electromagnetic slip clutch, said compensating roller and said support component being mounted on the respective said carrier.

3. A stranding machine as defined in claim 1, wherein said support component is a pivotally held compensating arm; said armature being operatively connected to said compensating arm for exerting a torque to said compensating arm in said second direction as a function of the torque applied to said armature by said rotating electromagnetic field.

4. A stranding machine as defined in claim 3, further comprising counterweight means attached to said compensating arm for counteracting centrifugal forces acting on said compensating arm.

5. A stranding machine as defined in claim 4, wherein said counterweight means comprises two counterweights.

6. A stranding machine as defined in claim 3, wherein said compensating roller and said compensating arm are essentially plastic.

7. A stranding machine as defined in claim 6, wherein said plastic is fiber-reinforced.

8. In a stranding machine including a plurality of reels on which filament to be stranded is wound; means for stranding together, with a stranding speed, the filaments taken off the reels; a separate, rpm-controllable motor operatively connected with each said reel; rpm control means operatively connected to each reel motor for controlling the reel rpm with respect to the stranding speed to determine the tension of the filament running from the reel; a separate compensating roller associated with each reel; the filament running from each reel being at least partially trained about a respective said compensating roller; a separate support component carrying a respective said compensating roller and being displaceable in opposite first and second directions; each said support component being operatively coupled to the respective said rpm control means for controlling the rpm of the respective said reel drive motor as a function of displacement of said support component; said filament, as it runs about the compensating roller, exerting a force on said support component, urging said support component in said first direction; and a force exerting assembly operatively connected with each said support component for exerting a force on said support component in said second direction; the improvement wherein said force exerting assembly comprises (a) an electromagnetic slip clutch including
  (1) a stator winding for generating an electromagnetic field;
  (2) an armature arranged to be exposed to a force derived from said electromagnetic field; said armature being connected to said support component for exerting thereon the force acting in said second direction as a function of the force applied to said armature by said electromagnetic field;
(b) current supply means for applying current to said stator winding and
(c) current control means connected to said current supply means for setting the intensity of the current applied to said stator winding for determining the strength of said electromagnetic field.

9. A stranding machine as defined in claim 8, wherein said armature is a rotary component and said force acting in said second direction is a torque exerted by said armature; further wherein said support component is a pivotally held compensating arm; said armature being operatively connected to said compensating arm for exerting said torque to said compensating arm in said second direction.

10. A stranding machine as defined in claim 9, wherein said electromagnetic clutch further comprises a rotor cooperating with said stator winding; motor means for rotating said rotor for generating a rotary electromagnetic field as a function of the current intensity in said stator winding, said rotary electromagnetic field exerting a torque on said armature.

* * * * *